US011767715B2

(12) United States Patent
Estes et al.

(10) Patent No.: US 11,767,715 B2
(45) Date of Patent: Sep. 26, 2023

(54) UNDERREAMER

(71) Applicant: TRANSCO MANUFACTURING AUSTRALIA PTY LTD, Lonsdale (AU)

(72) Inventors: Roy Estes, Lonsdale (AU); George Fyfe, Lonsdale (AU)

(73) Assignee: TRANSCO MANUFACTURING AUSTRALIA PTY LTD, Lonsdale (AU)

( * ) Notice: Subject to any disclaimer, the term of this patent is extended or adjusted under 35 U.S.C. 154(b) by 72 days.

(21) Appl. No.: 16/757,110

(22) PCT Filed: Oct. 19, 2018

(86) PCT No.: PCT/AU2018/000203
§ 371 (c)(1),
(2) Date: Apr. 17, 2020

(87) PCT Pub. No.: WO2019/075508
PCT Pub. Date: Apr. 25, 2019

(65) Prior Publication Data

US 2020/0240215 A1 Jul. 30, 2020

(30) Foreign Application Priority Data

Oct. 20, 2017 (AU) ..... 2017904251

(51) Int. Cl.
*E21B 7/28* (2006.01)
*E21B 10/34* (2006.01)
*E21B 10/32* (2006.01)

(52) U.S. Cl.
CPC ..... *E21B 10/325* (2013.01); *E21B 7/28* (2013.01); *E21B 10/34* (2013.01); *E21B 10/345* (2013.01)

(58) Field of Classification Search
CPC ..... E21B 10/325; E21B 10/345; E21B 10/34; E21B 7/28
See application file for complete search history.

(56) References Cited

U.S. PATENT DOCUMENTS 1,607,662 A * 11/1926 Boynton ..... E21B 10/322 175/269
2,238,998 A * 4/1941 Grant ..... E21B 10/345 175/267

(Continued)

FOREIGN PATENT DOCUMENTS

WO 2015/114406 A1 8/2015

OTHER PUBLICATIONS

International Search Report and Written Opinion dated Dec. 21, 2018 for International Application No. PCT/AU2018/000203, 5 pages.

(Continued)

*Primary Examiner* — Blake Michener
(74) *Attorney, Agent, or Firm* — SEED IP LAW GROUP LLP

(57) ABSTRACT

The present disclosure relates to an underreamer. In one aspect, the underreamer comprises a body, the body comprising at least one pocket therein, the underreamer further comprising at least one cutter secured with respect to the body, at least one actuating mechanism for moving the cutter between a retracted position in the pocket, and an extended position in which only the cutter projects from the body. In one aspect, the or each actuating mechanism comprises a piston for driving extension of the cutter, and a linkage to a cutter arm with respect to which the cutter is mounted, and a return spring for biasing the cutter to the retracted position.

20 Claims, 3 Drawing Sheets

(56) References Cited

U.S. PATENT DOCUMENTS

| | | | | |
|---|---|---|---|---|
| 2,545,033 | A * | 3/1951 | Kammerer | E21B 10/34 175/290 |
| 2,790,625 | A * | 4/1957 | Dean | E21B 10/34 175/277 |
| 2,868,510 | A * | 1/1959 | Dean | E21B 10/34 175/271 |
| 3,425,500 | A | 2/1969 | Fuchs | |
| 6,886,633 | B2 * | 5/2005 | Fanuel | E21B 10/322 166/269 |
| 7,314,099 | B2 | 1/2008 | Dewey et al. | |
| 2008/0251294 | A1 | 10/2008 | Minshull | |
| 2010/0089583 | A1 * | 4/2010 | Xu | E21B 10/32 175/57 |
| 2014/0332270 | A1 | 11/2014 | Odell, II et al. | |

OTHER PUBLICATIONS

Extended European Search Report, dated Jun. 8, 2021, for European Application No. 18867718.1-1002, 7 pages.

* cited by examiner

UNDERREAMER

PRIORITY DOCUMENTS

The present application claims priority from Australian Provisional Patent Application No. 2017904251 titled "UNDERREAMER" and filed on 20 Oct. 2017, the content of which is hereby incorporated by reference in its entirety.

TECHNICAL FIELD

The present disclosure relates to an underreamer.

BACKGROUND

Underreaming is defined as the process of enlarging a wellbore past its originally drilled size.

A successful underreaming job is defined as a job which results in a full gauge hole, underreamed in the least amount of time without leaving junk in the hole. All three of these aspects of the job must be weighed against each other. If a tool is left in the hole too long, the chances of leaving junk in the hole increase. If penetration rates are too high, a corkscrewed, under-gauged hole may result.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY

According to a first aspect, there is provided an underreamer comprising a body, the body comprising at least one pocket therein, the underreamer further comprising at least one cutter mounted with respect to the body, at least one actuating mechanism for moving the cutter between a retracted position in the pocket, and an extended position in which only the cutter projects from the body.

That is to say, no part of the actuating mechanism projects from the body when the cutter is extended.

In one form, the body of the underreamer is elongate, and when the cutter is retracted, an axis of rotation of the cutter is or near to parallel with an axis of elongation of the body.

In one form, when the cutter is extended, the axis of rotation of the cutter is or near to perpendicular to the axis of elongation of the body.

In one form, the underreamer comprises a plurality of cutters, and a pocket and an actuating mechanism for each cutter.

In one form, the plurality of cutters is spaced apart about the circumference of the body.

In one form, the plurality of cutters is equispaced about the circumference of the body.

In one form, the or each actuating mechanism comprises a biasing means which biases the cutter towards its retracted position.

In one form, the or each actuating mechanism comprises an arm which is pivotally connected with respect to the body, and with respect to which the cutter is mounted.

In one form, the or each actuating mechanism comprises a piston which is slidably disposed in a bore for driving cutter extension, and linked to the arm to drive pivotal rotation of the arm.

In one form, the cutter is secured with respect to the arm at or near a first end thereof, and the piston is linked to the arm at or near a second end thereof.

In one form, the pivot point for the arm is between the cutter and the piston linkage point.

In one form, a central drilling fluid bore extends through the body, and for each cutter a channel extends from the central drilling fluid bore to the piston bore to deliver drilling fluid to the piston bore to drive the piston and thus the cutter to its extended position.

In one form, the body of the underreamer is cylindrical and comprises a pair of ends, and in use, its axis of elongation extends between these ends.

In one form, each of the ends of the body of the underreamer comprises a threaded connection for connecting the body with a drill string.

In one form, the body of the underreamer comprises at least one junk slot extending lengthwise along an outer surface thereof.

In one form, the body of the underreamer comprises a plurality of the junk slots.

In one form, the plurality of the junk slots are equispaced about the circumference of the body.

In one form, the or each cutter is a rolling cone cutter.

According to a further aspect there is provided an underreamer comprising a body, the body comprising at least one pocket therein, the underreamer further comprising at least one cutter mounted with respect to the body, at least one actuating mechanism for pivoting the cutter between a retracted position in the pocket, and an extended position in which the or each cutter is oriented to cut formation.

In one form, the or each actuating mechanism comprises a piston for driving extension of the cutter, a linkage to a cutter arm with respect to which the cutter is mounted.

In one form, the or each actuating mechanism comprises a return spring for biasing the cutter to the retracted position.

BRIEF DESCRIPTION OF DRAWINGS

Embodiments of the present invention will be discussed with reference to the accompanying drawings wherein.

In the following description, like reference characters designate like or corresponding parts throughout the figures.

DESCRIPTION OF EMBODIMENTS

Figure 1:
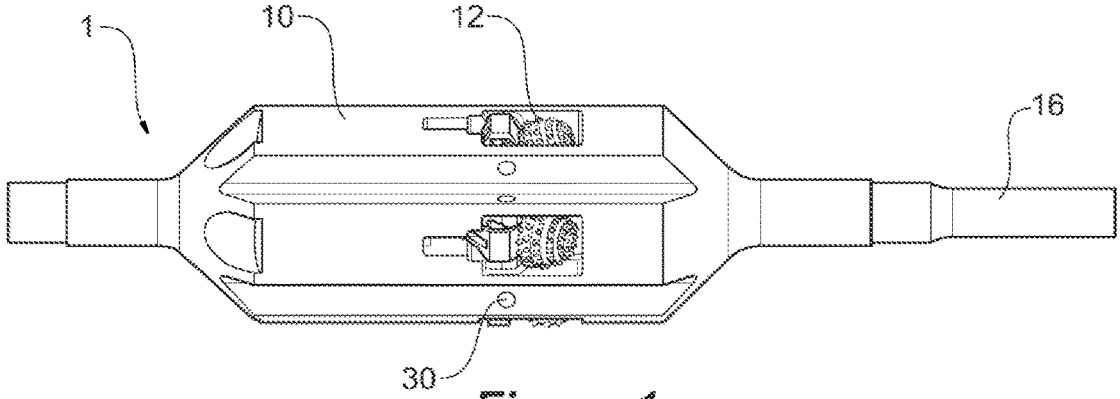
FIG. 1 is a side view of an underreamer with its cutters retracted.

Referring now to FIG. 1, where there is shown an underreamer 1 comprising a body 10, the body 10 comprising a plurality of pockets 22 therein, and for each pocket 22 a cutter 12 mounted with respect to the body 10, and for each cutter 12 an actuating mechanism for moving the cutter 12 between a retracted position in the pocket 22, and an extended position in which only the cutter 12 projects from the body 10.

Figure 2:
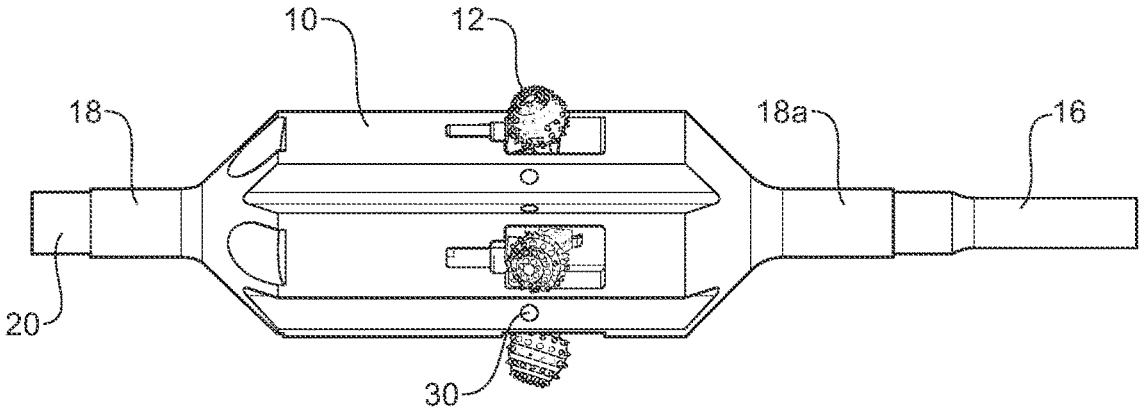
FIG. 2 is a side view of the underreamer with its cutters extended.
Figure 3:
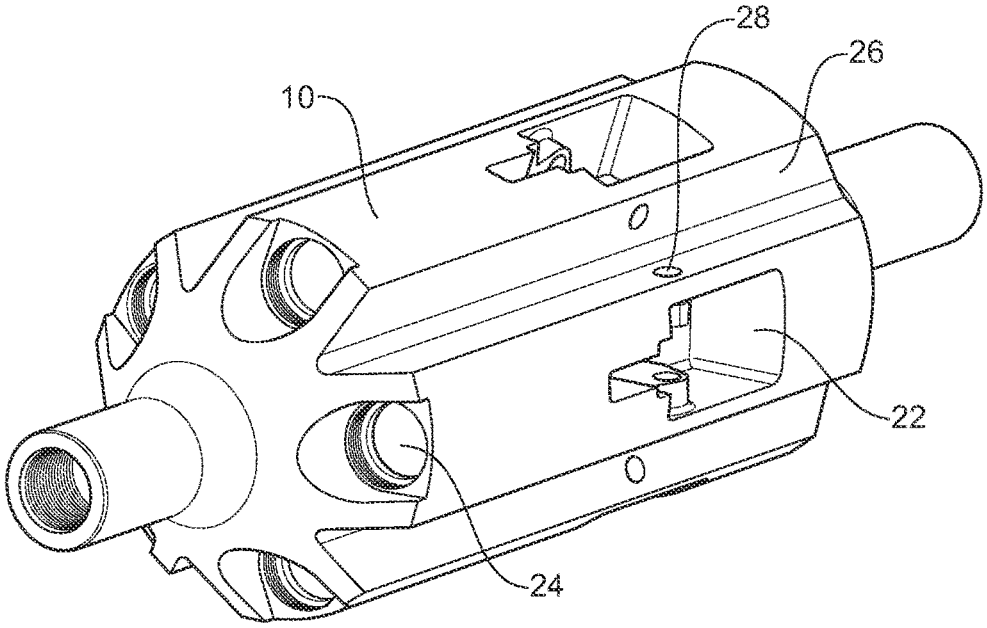
FIG. 3 is an isometric view of a body of the underreamer of FIG. 1.

In FIG. 1, the cutters 12 are retracted in the pocket 22 of the underreamer body 10, and in FIG. 2 they are shown extended.

In the illustrated embodiment the body 10 is an integral unit machined from a steel forging. Each end of the body 10 comprises a threaded connection 18 and 18*a*, for connecting the body 10 with a drill string. In this way, the underreamer 1 can be used with a drill rig either pushing or pulling via the drill string.

In FIG. 1, the body 10 is attached to a drill pipe 16 at connection 18*a*. The drill pipe 16 is part of the drill string that connects the underreamer 1 with the drill rig (not illustrated). The drill string transmits drilling fluid, linear force (WOB) and rotational torque from the drill rig to the underreamer 1. The connection 18 at the other end is fitted with a plug 20 that prevents drilling fluid from passing all the way through the underreamer 1.

In FIGS. 1 and 2 the drill string is pulling the underreamer to the rig as it enlarges the bore. To enlarge the bore while pushing from the drill rig, the drill pipe 16 would need to be attached to connection 18, and the plug 20 would need to be attached to connection 18*a*.

Each of the pockets 22 in the body 10 of the underreamer 1 is sized and shaped to receive a cutter 12 and the actuating mechanism therefor. For each pocket 22, there is an associated piston cylinder bore 24.

Junk slots 26 allow cuttings and drilling fluid to flow past the body 10. Holes 28 for cutter 12 pivot pins 30 are drilled between the junk slots 26 and through the pockets 22.

Figure 4A:
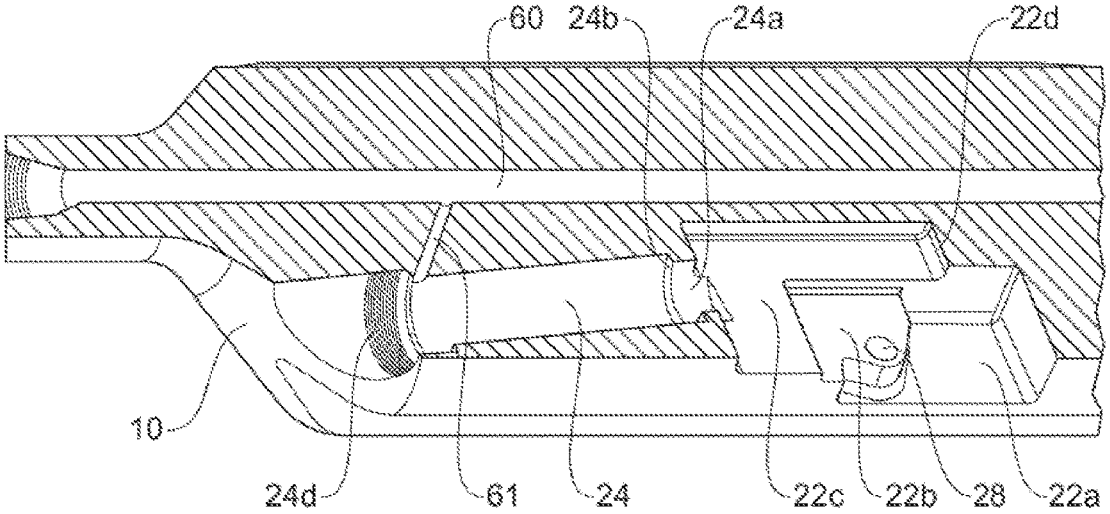
FIG. 4*a* is a cross sectional view through a pocket in the body of the underreamer.

With reference to FIG. 4*a*, it can be seen that a cone pocket 22*a* is the widest portion of the cutter pocket 22. A width of a segment guide portion 22*b* is slightly greater than a width of the cutter segment 31. Sides of the guide portion 22*b* transmit rotary torque to the cutter segment 31. A narrow and deep portion 22*c* of cutter pocket 22 is a clearance area for a cutter arm 32 and a linkage 40.

Figure 4:
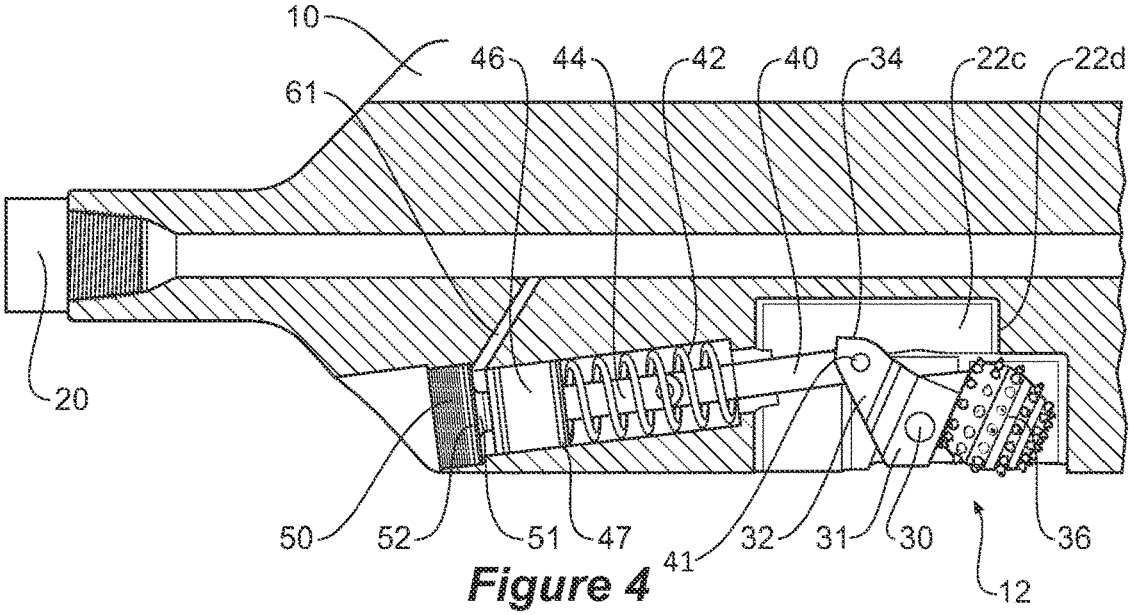
FIG. 4 is a cross sectional view through a pocket in the body of the underreamer illustrating the cutter actuation mechanism.

With reference to FIG. 4, it can be seen that the cutter 12 comprises a cutter cone 36 rotatably mounted on the cutter segment 31. The cutter 12 is pivotally secured with respect to the body 10 by pivot pins 30 located in the holes 28.

Each actuating mechanism 24 comprises a piston 46 which is slidably disposed in its respective bore 24, and a linkage 40 extending from a tang 44 on the piston 46, through an opening 24*a* in the end of the bore, to the arm 32 of the cutter segment 31, which is pivotally connected with respect to the body 10, and with respect to which the cutter 12 is mounted.

Linkage 40 is attached at each end by axis pins 41 that allow slight rotation as the cutter 12 moves between the retracted and extended positions. A spring 42 is in compression between a shoulder 24*b* of the bore 24 and the piston 46, to bias the piston 46 to a home position, and bias the cutter to its retracted position in turn. The piston 46 comprises wiper seals 47 at each end, which prevent fluid leaking thereby.

A plug 50 is threaded into a mouth 24*d* of cylinder bore 24. The plug 50 comprises a seal 52 and an extension 51 which extends into the bore 24. The extension 51 provides a chamber 53 between piston 46 and plug 50. A channel 61 connects a central drilling fluid bore 60 extending through the body 10, to the chamber 53.

Figure 4B:
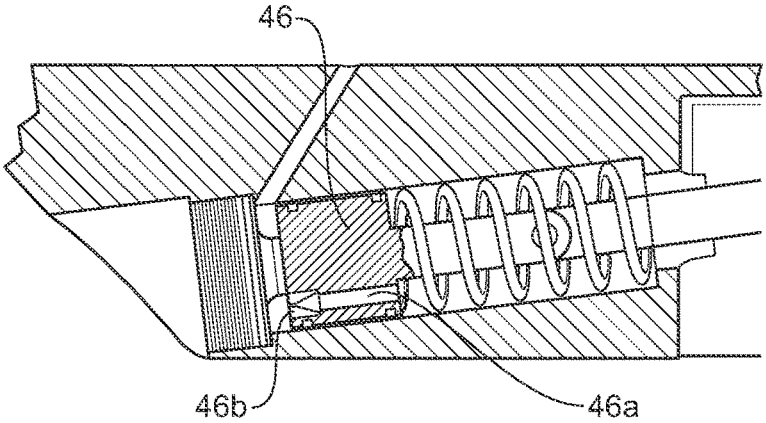
FIG. 4*b* is a cross sectional view through a pocket in the body of the underreamer illustrating the actuation mechanism.

FIG. 4*b* shows a section view through the piston 46. A channel 46*a* is drilled through the piston 46 and a diffusion jet 46*b* with a small orifice is mounted in the high pressure end. This allows a continuous flow of fluid through the cylinder 24 and cutter pocket 22 while the underreamer is drilling, to prevent them from packing with cuttings.

Figure 5:
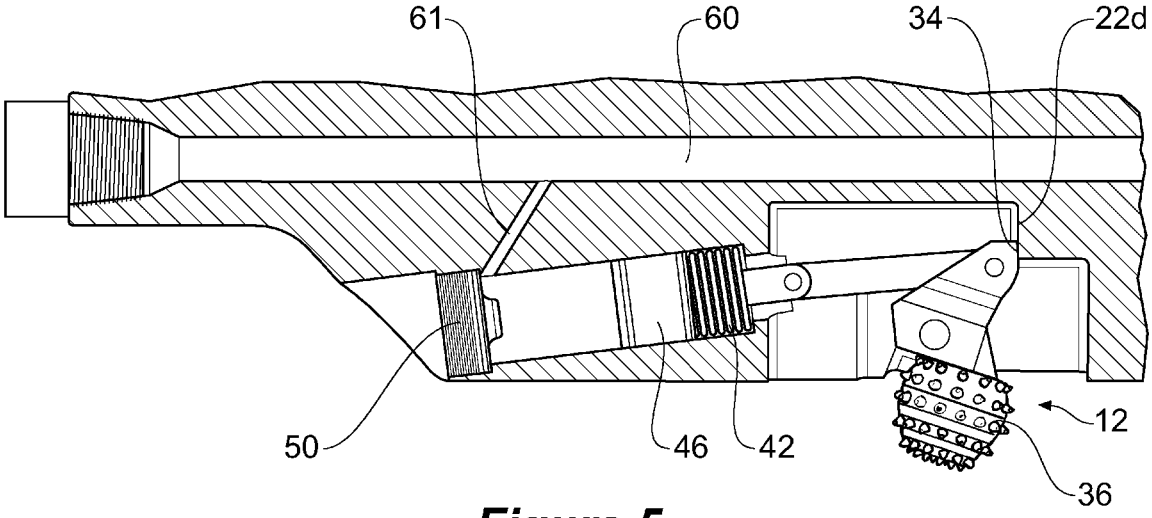
FIG. 5 is a cross sectional view through a pocket in the body of the underreamer illustrating the cutter and its actuation mechanism.

FIG. 5 shows the cutter/actuator assembly extended in a sectioned body 10. When the drill rig starts, the mud pumps begin circulating drilling fluid at high pressure which will simultaneously force all of the cutters 12 to their extended positions. High pressure drilling fluid passes through the drill string and fluid bore 60 and each of the connecting channels 61 to the chambers 53, to drive each piston 46 to move inward from its home position, compressing spring 42 and extending each cutter 12. Cutter 12 is locked in place during reaming by formation pressure against the cone 36 (see FIG. 6) and surface 34 on the cutter segment contacting surface 22*d* in the cutter pocket 22, which also prevents further rotation of the cutter 12.

As the underreamer 1 is rotated with drilling fluid pressure forcing the cutters 12 outward, the cones 36 cut/drill formation to allow the cutters 12 to fully extend. That is to say, the cutters 12 will effectively cut their own clearance for them to extend into.

An advantage of the underreamer 10 is that the cones 36 of the cutters face outward and can cut/drill into the formation as the cutters 12 extend. All prior art underreamers have cutters facing inward, and as a result, they need an annular space to open the cutters—or very soft formation. In contradistinction, the cutters 12 of the underreamer 1 according to the present invention will cut their own annular space.

Figure 6:
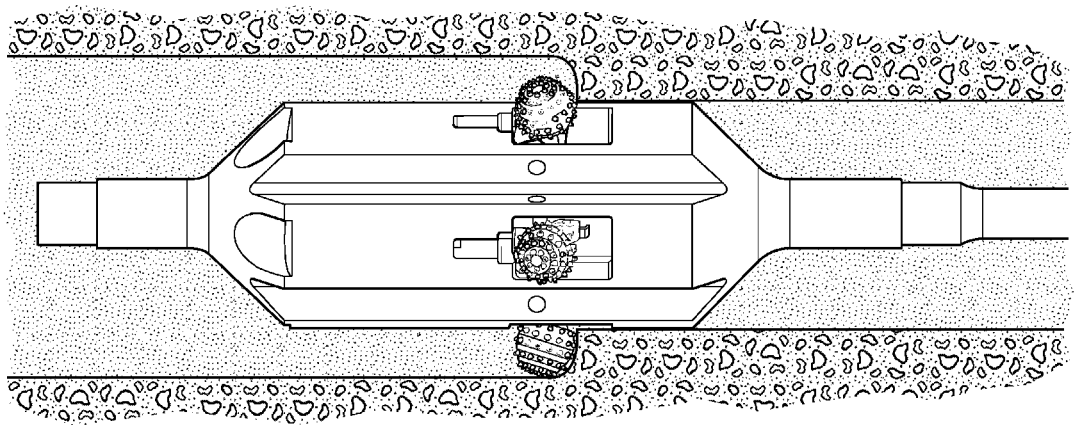
FIG. 6 illustrates the underreamer in a bore with its cutters extended.

FIG. 6 shows the underreamer in operating mode reaming/drilling to the right of the page with original size bore, and the enlarged bore on the left of the page.

Figure 7:
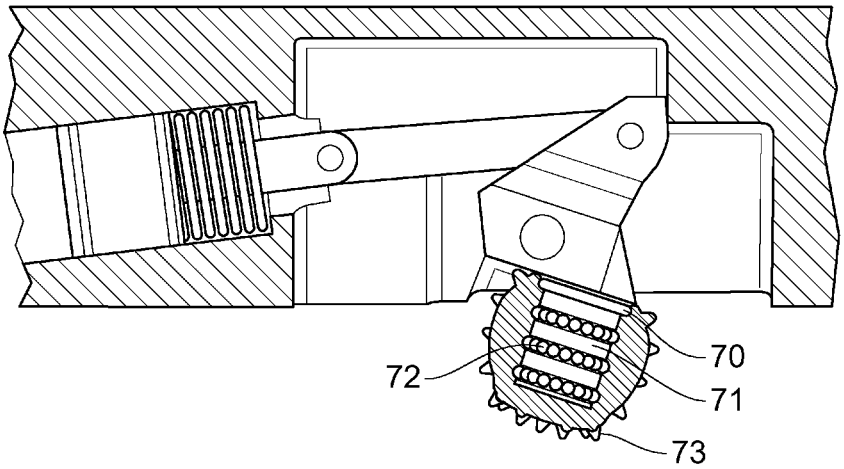
FIG. 7 is a cross sectional view through a pocket in the body of the underreamer illustrating the cutter and its actuation mechanism, with the cutter extended.

FIG. 7 shows a bearing configuration for the outward facing cutter 12. The cutter working as shown in FIG. 6 will have a continuous moderate to light outboard thrust load on the bearing. Standard rock bit bearings have a moderate to heavy continuous inboard (to the bearing) thrust load. A standard rock bit bearing will not function on this type of cutter 12.

The cutter cones 36 comprise well known cutting elements, such as typical tooth-shaped cutting elements, insert type cutting elements, or fixed cutters such as polycrystalline diamond compact cutters. It will be appreciated that the cutter cones 36, and the cutting elements, may be selected and changed out based on the required cutting mechanism (i.e. tooth-shaped or insert type cutting elements may be selected for fracturing or crushing formation, and fixed cutters may be selected for shearing or grinding formation).

The bearing configuration comprises three friction sleeve bearings 71 which carry the biggest part of the bearing load, and three ball races filled with balls 72, which carry the outboard thrust load.

The three ball races on the bearing in FIG. 7 are designed to operate with an outboard thrust. The bearing is sealed with seal 70, and has a lubrication system with an equalizing compensator (lubrication system not shown).

Compared to traditional rock bit bearings this bearing is new in that the load carrying portion of the segment ball races—the half of the ball race that is farthest from the O-ring will have exactly the same radius as the ball bearing radius or possibly be 0.001" to 0.003" smaller than the ball bearing radius. There are three ball races that will be precisely positioned so that all three will carry load at the same time. Traditionally the radius of the loaded part of the segment ball race is 0.003" to 0.006" larger than the ball bearing radius.

A profile of the cone 36 is such that insert row 73, which cuts the gauge wall of the hole will hold many inserts.

In operation, the underreamer is attached to the drill string and positioned at the desired place the enlarged bore is desired. The mud pumps are turned on. Mud pressure and rotation are increased slowly while the cutters 12 extend, then drill ahead.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. An underreamer comprising a body, the body comprising at least one pocket therein, the underreamer further comprising a plurality of cutters secured with respect to the body, and for each cutter of the plurality of cutters a respective pocket and a respective actuating mechanism comprising a piston which is slidably disposed in a piston bore, a linkage which has a first end mechanically coupled to the piston, an arm at a second end of the linkage opposite to the first end, and an axis pin which directly, mechanically and rotatably couples the arm to the second end of the linkage for moving the cutter between a retracted position within the pocket and an extended position in which only the cutter projects from the body, and wherein a central drilling fluid bore extends through the body and a plurality of channels extend from the central drilling fluid bore to the piston bores to deliver drilling fluid to drive the pistons and thus the cutters to their extended positions.

2. The underreamer of claim 1, wherein when at least one of the plurality of cutters is retracted, an axis of rotation of the at least one of the plurality of cutters is or near to parallel with an axis of elongation of the body.

3. The underreamer of claim 2, wherein when the at least one of the plurality of cutters is extended, the axis of rotation of the at least one of the plurality of cutters is or near to perpendicular to the axis of elongation of the body.

4. The underreamer of claim 1, wherein the plurality of cutters are spaced apart about a circumference of the body.

5. The underreamer of claim 1, wherein the plurality of cutters are equispaced about the circumference of the body.

6. The underreamer of claim 1, wherein each of the actuating mechanisms comprises a spring which biases a corresponding cutter of the plurality of cutters towards the retracted position.

7. The underreamer of claim 1, wherein each of the arms of each of the actuating mechanisms is pivotally connected with respect to the body, and each respective cutter of the plurality of cutters is mounted to a corresponding arm of a corresponding actuating mechanism of the actuating mechanisms.

8. The underreamer of claim 7, wherein each of the pistons of each of the actuating mechanisms is linked to a corresponding arm of a corresponding actuating mechanism of the actuating mechanisms to drive pivotal rotation of the corresponding arm.

9. The underreamer of claim 8, wherein a pivot point for each of the arms of each of the actuating mechanisms is between a corresponding cutter of the plurality of cutters and a corresponding linkage point of a plurality of linkage points each at a corresponding axis pin of the axis pins of each of the actuating mechanisms.

10. The underreamer of claim 1, wherein each respective cutter of the plurality of cutters is a rolling cone cutter.

11. The underreamer of claim 1, wherein the body of the underreamer is cylindrical and comprises a pair of ends, and in use, an axis of elongation of the body of the underreamer extends between the pair of ends.

12. The underreamer of claim 11, wherein each of the ends of the body of the underreamer comprises a threaded connection for connecting the body with a drill string.

13. The underreamer of claim 1, wherein the body of the underreamer comprises at least one junk slot extending lengthwise along an outer surface thereof.

14. The underreamer of claim 1, wherein, when moving at least one cutter of the plurality of cutters between the retracted position and the extended position, a corresponding arm of the arms rotates about a corresponding axis pin of the axis pins.

15. The underreamer of claim 14, further comprising:

an opening in the body and within the pocket; and a pivot pin in the fourth end of the arm and in the opening, and wherein, when moving the cutter between the retracted position and the extended position, the fourth end of the arm rotates about the pivot pin and the third end of the arm rotates about the axis pin.

16. The underreamer of claim 1, wherein each cutter of the plurality of cutters is a part of a removable insert for the body.

17. An underreamer comprising a body, the body comprising at least one pocket therein, the underreamer further comprising a plurality of cutters mounted with respect to the body, and for each of the plurality of cutters a respective pocket and a respective actuating mechanism comprising a piston which is slidably disposed in a piston bore, a linkage which has a first end mechanically coupled to the piston, an arm at a second end of the linkage opposite to the first end, and an axis pin which directly, mechanically and rotatably couples the arm to the second end of the linkage for pivoting the cutter between a retracted position within the pocket and an extended position in which the cutter is oriented to a cut formation, and wherein a central drilling fluid bore extends through the body, and for each cutter of the plurality of cutters a channel extends from the central drilling fluid bore to the piston bores to deliver drilling fluids to drive the piston and thus the cutters to their extended positions.

18. The underreamer of claim 17, wherein each of the pistons of each of the actuating mechanisms is for driving extension of a corresponding cutter of the plurality of cutters, and each of the actuating mechanisms includes a corresponding linkage of the linkages coupled to a corresponding cutter arm with respect to which the corresponding cutter of the plurality of cutters is mounted.

19. The underreamer of claim 18, wherein each of the actuating mechanisms comprises a return spring for biasing the corresponding cutter of the plurality of cutters to the retracted position.

20. An underreamer, comprising a body, the body comprising at least one pocket therein, the underreamer further comprising a plurality of cutters secured with respect to the body, and for each cutter of the plurality of cutters a respective pocket and a respective actuating mechanism comprising a piston which is slidably disposed in a piston bore, a linkage which has a first end mechanically coupled to the piston, a third end of an arm at a second end of the linkage opposite to the first end, a fourth end of the arm opposite to the third end, and an axis pin in the second end of the linkage and in the third end of the arm which mechanically and rotatably couples the third end of the arm to the second end of the linkage for moving the cutter between a retracted position within the pocket and an extended position in which only the cutter projects from the body, and wherein a central drilling fluid bore extends through the body and a plurality of channels extend from the central drilling fluid bore to the piston bores to deliver drilling fluid to drive the pistons and thus the cutters to their extended positions.

* * * * *